US007748189B2

(12) United States Patent
Fujii

(10) Patent No.: US 7,748,189 B2
(45) Date of Patent: Jul. 6, 2010

(54) TILE AND TACK THEREFOR

(75) Inventor: Yoshio Fujii, Okayama (JP)

(73) Assignee: Cosmic Garden Co., Ltd. (JP)

( * ) Notice: Subject to any disclaimer, the term of this patent is extended or adjusted under 35 U.S.C. 154(b) by 872 days.

(21) Appl. No.: 11/628,438

(22) PCT Filed: May 27, 2005

(86) PCT No.: PCT/JP2005/009762

§ 371 (c)(1),
(2), (4) Date: Dec. 4, 2006

(87) PCT Pub. No.: WO2005/121476

PCT Pub. Date: Dec. 22, 2005

(65) Prior Publication Data

US 2008/0016813 A1 Jan. 24, 2008

(30) Foreign Application Priority Data

Jun. 8, 2004 (JP) ..... 2004-169617

(51) Int. Cl.
*E04D 1/00* (2006.01)

(52) U.S. Cl. ..... 52/519; 52/518; 52/527; 52/536; 52/535; 52/542

(58) Field of Classification Search ..... 52/518, 52/519, 527, 536, 535, 542
See application file for complete search history.

(56) References Cited

U.S. PATENT DOCUMENTS 1,492,190 A * 4/1924 Aycock ..... 52/535
1,986,739 A * 1/1935 Mitte ..... 52/591.4
2,071,229 A * 2/1937 Heppes et al. ..... 52/535
2,078,039 A * 4/1937 Stoner ..... 52/535
3,852,934 A * 12/1974 Kirkhuff ..... 52/539
4,301,633 A * 11/1981 Neumann ..... 52/309.4
4,603,529 A * 8/1986 Cronenwett et al. ..... 52/536
4,717,614 A * 1/1988 Bondoc et al. ..... 428/143
4,731,969 A * 3/1988 Baker et al. ..... 52/536
4,854,102 A * 8/1989 Feil et al. ..... 52/535
4,869,942 A * 9/1989 Jennus et al. ..... 428/77
4,890,432 A * 1/1990 Shepherd ..... 52/314
4,914,885 A * 4/1990 Baker et al. ..... 52/520
5,060,444 A * 10/1991 Paquette ..... 52/535

(Continued)

FOREIGN PATENT DOCUMENTS

JP 54-55119 4/1979

(Continued)

*Primary Examiner*—Richard E Chilcot, Jr.
*Assistant Examiner*—Mark R Wendell
(74) *Attorney, Agent, or Firm*—Thompson Hine LLP

(57) ABSTRACT

A tile having a self-interlocking mechanism urges rain water running on the surface of the tile to run downward thus making it for rain water to leak less through a joint. The tile includes a tile base, an underlap portion on each of an upper side area and one of a left-hand side area and a right-hand side area of the tile base, and an overlap portion on each of a lower side area and the other of the left-hand side area and the right-hand side area of the tile base. The tile may be arranged horizontally and vertically in a plain in a self-interlocking manner. The tile includes a tilt portion tapered thinner toward the lower end of the tile base.

9 Claims, 11 Drawing Sheets

U.S. PATENT DOCUMENTS

| | | | | |
|---|---|---|---|---|
| 5,305,570 | A * | 4/1994 | Rodriguez et al. | 52/520 |
| 5,323,581 | A * | 6/1994 | Jakel | 52/519 |
| 5,502,940 | A * | 4/1996 | Fifield | 52/309.12 |
| 5,540,029 | A * | 7/1996 | Elias | 52/536 |
| 5,737,881 | A * | 4/1998 | Stocksieker | 52/90.1 |
| 5,743,059 | A * | 4/1998 | Fifield | 52/519 |
| 6,367,221 | B1 * | 4/2002 | Elliott | 52/519 |
| 6,494,010 | B1 * | 12/2002 | Miller et al. | 52/578 |
| 6,510,664 | B2 * | 1/2003 | Kupczyk | 52/528 |
| 6,530,189 | B2 * | 3/2003 | Freshwater et al. | 52/553 |
| 6,948,288 | B1 * | 9/2005 | Smith | 52/409 |
| 7,003,922 | B2 * | 2/2006 | Fifield | 52/302.1 |
| 7,328,534 | B2 * | 2/2008 | Dinwoodie | 52/173.3 |
| 7,331,150 | B2 * | 2/2008 | Martinique | 52/520 |
| 7,520,098 | B1 * | 4/2009 | Martinique et al. | 52/309.2 |
| 7,596,919 | B1 * | 10/2009 | Vande Hey et al. | 52/533 |
| 2002/0038531 | A1 * | 4/2002 | Freshwater et al. | 52/518 |
| 2002/0189189 | A1 * | 12/2002 | Kupczyk | 52/557 |
| 2003/0046891 | A1 * | 3/2003 | Colada et al. | 52/518 |
| 2003/0115819 | A1 * | 6/2003 | Fifield | 52/533 |
| 2004/0172909 | A1 * | 9/2004 | Gabbard et al. | 52/535 |
| 2006/0068188 | A1 * | 3/2006 | Morse et al. | 428/304.4 |
| 2008/0028705 | A1 * | 2/2008 | Morse et al. | 52/309.12 |

FOREIGN PATENT DOCUMENTS

| | | |
|---|---|---|
| JP | 57-89735 | 6/1982 |
| JP | 63-122857 | 5/1988 |
| JP | 63-106842 | 7/1988 |
| JP | 07-062830 | 3/1995 |
| JP | 2001-164706 | 6/2001 |
| JP | 2002-081175 | 3/2002 |
| JP | 2002-096313 | 4/2002 |
| JP | 2003-020771 | 1/2003 |

* cited by examiner

TILE AND TACK THEREFOR

This application is a national phase application of International Application No. PCT/JP2005/009762, which claims priority from Japanese Patent Application No. 2004-169617 filed on Jun. 8, 2004, the entire contents of which are incorporated herein by reference.

TECHNICAL FIELD

The present invention relates to a tile for use as interior or exterior covering materials of buildings and, in particular, to a tile that includes an underlap portion on a upper side thereof and a right-hand side and an overlap portion, identical in shape to the underlap portion, on a lower side and a left-hand side thereof, and is arranged in a self-interlocking mechanism with surrounding identical tiles above, below and on the left and right-hand sides thereof.

BACKGROUND ART

Tiles having a self-interlocking mechanism and the clamping structure thereof for use as a wall material or a floor material are disclosed Patent Documents 1, 2, 3, and 4.

The typical structure of the tile for use as a wall material is discussed herein. The conventional tile has rear projection portions (underlap portions) on the two sides of the rear surface thereof and front projection portions (overlap portions) on the other two sides of the front surface thereof. Furring strips are attached on a waterproof sheet on posts and intermediate posts erected at regular pitches, and a plurality of tiles arranged in an interlocking engagement are fixed onto backing materials (posts, intermediate posts, and furring strips) with nails. Thus, an external wall of a building is formed.

Patent Document 1: Japanese Utility Model Laid-open Gazette No. 54-55119

Patent Document 2: Japanese Utility Model Laid-open Gazette No. 7-71333

Patent Document 3: Japanese Patent Laid-open Gazette No. 7-62830

Patent Document 4: Japanese Patent Laid-open Gazette No. 2003-20771

SUMMARY OF THE INVENTION

The conventional tiles are arranged vertically and horizontally in a self-interlocking manner with a rear projection portion of one tile engaged with a front projection portion of another tile. This arrangement provides excellent waterproofness in horizontal joints and vertical joints of the tiles. However, the set tiles have typically a vertical flat surface with no slope for running water. Rain water slowly flows on the surface of the tiles, thereby tending to leak into through the horizontal joints.

The present invention has been developed to solve the above-referenced problem. It is an object of the present invention to provide tiles that are less subject to water ingress through joints by urging rain water to run downward along the surface of the tiles.

To achieve the above object, the present invention provides a tile that includes a tile base, an underlap portion formed on each of an upper side and one of a right-hand side and a left-hand side of the tile base, and an overlap portion having identical shape with the underlap portion and formed on each of a lower side and the other of the right-hand side and the left-hand side of the tile base. The tile is arranged vertically and horizontally in a self-interlocking manner with other identical tiles and characterized by having a tilt portion tapered thinner toward the lower end of a front surface of said tile base. With this arrangement, the tilt portion increases the speed of movement of rain water along the surface of the tiles, thereby making it for the rain water to leak less. The tile having the tilt portion provides an impressive appearance different from the conventional tiles, and is appealing in aesthetical point of view. The tiles of this invention can be set using known tile setting methods.

In accordance with claim 2, the tile includes a step portion having a step size equal to a thickness of the lower side of the overlap portion and formed at a position lower than the upper side of the tile base by a distance equal to a dimension of the lower side of the overlap portion. The underlap portion includes an area defined by the upper side of the tile base and the step portion. The tiles are thus arranged in a self-interlocking manner with the overlap portion engaged with the underlap portion. With this arrangement, the underlap portion is formed on the surface of the tile base except the tilt portion. The variety of combination of the tiles is increased, and the applications of the tiles are widened. The tiles may be selectively set, more specifically, the lower side overlap portion of one tile may be engaged with the upper side underlap portion of another tile or may be engaged with the front surface underlap portion formed defined by the step portion. The tiles in the former setting are appropriate for use in wall and floor applications, and the tiles in the latter setting are appropriate for use as roof tiles because tiles adjacent to each other in slope direction are inclined depending on the thickness of the front surface underlap portion formed on the front surface of the tile base of each tile.

In accordance with claim 3, a clamp portion is projected from a rear upper side of the upper side of the underlap portion. The clamp portion is engaged with a backing horizontal bar. In this arrangement, each tile can easily register in position with the clamp portion.

In accordance with claim 4, the tile includes a rear foot portion formed on a rear surface of said tile base and having a slope surface running in parallel with said tilt portion. When the tiles of the present invention are set to form the wall of a building, the rear foot portion is securely engaged with the backing material. In this arrangement, the entire tile is inclined at a tilt angle defined by the rear foot portion. As a result, the tilt portion is placed in alignment with a vertical axis.

The tile may have the rear foot portion with a thickness dimension thereof equaling the height of a roof tile fillet. When the tiles of the present invention are used as roof tiles, the roof tile fillet becomes unnecessary.

When the tiles of the present invention are used as roof tiles, the rear foot portion may not be in parallel with the front surface tilt portion. The use of the roof tile fillet becomes unnecessary by arranging on the rear lower side of the tile base the rear foot portion having the same dimension as the height of the roof tile fillet.

The tile of this sort is typically manufactured by baking press worked clay in a furnace. Each clay pieces was conventionally supported by a stand in the furnace to be baked. The stands of the number equal to the number of tiles to be manufactured are required. Arranging the clay tile on each stand and taking out the baked clay tile from the furnace took time. In accordance with the present embodiment, a projection is extended from a location on the front surface on the top portion of the upper side of the underlap portion, in a front-to-back symmetrical with the clamp portion. The projection is breakable. When the tile is placed on the ground with the upper side down, the projection and the clamp portion serve as feet. With this arrangement, the tile can stand alone in the furnace without the need for using the stand.

In accordance with the present invention, the rear surface of the underlap portion is extended to the lower side of the overlap portion to form a plug portion. A notch to be engaged with the plug portion is formed in the center of the projection. With the plug portion of the lower side overlap portion received in the notch, the tiles can be set in a hound's-tooth check pattern.

Since the projection helps the tile to stand alone in an upright position during the baking process, the projection can be broken away after the process. If the projection does not touch the lower side overlap portion in the self-interlocking arrangement when a wall is built, the entire projection can be left. If the projection touches the lower side overlap portion of another tile, the projection may be partly broken away to a certain length that permits the remaining projection clears of the lower side overlap portion. In any case, the remaining projection serves as a water barrier.

In accordance with claim 7, a recess is formed on the rear surface of the tile base. The weight of the tile is thus reduced by the volume of the recess. When the tile is manufactured by press working, the volume saved by the recess is used for the tilt portion. The material of the tile is economically used.

In accordance with claim 8, a tack for use with the tile includes a support portion supporting the front surface of the lower side overlap portion and a hook portion being bent at by around 90 degrees and then extending horizontally from one end of the support portion to the rear surface of the tile and then being bent downward to engage with the upper edge of a backing horizontal bar. With the tack, the tile can be securely fastened to the backing horizontal bar without using nails. Optionally, the tack may be manufactured of a single metal wire.

In accordance with the present invention, the front surface of the tile base having the self-interlocking structure has the tilt portion that tapered thinner downward. The tilt portion urges rain water to run more quickly, thereby preventing rain water from leaking through joints. The tilt portion is extended downward from the step portion, thereby forming the underlap portion on the front surface of the tile base. This arrangement increases the freedom of tile combination, and the tiles of the present invention find applications as a wall tile, a floor tile, and a roof tile. With the clamp portion arranged on the top rear surface of the upper side underlap portion, the tile can be easily registered in position with respect to the backing horizontal bar, and thus helps expedite construction schedule and rationalize construction work. With the recess arranged on the rear surface of the tile base, the tile is reduced in weight and the tilt portion is easily formed. Since the rear foot portion running in parallel with the tilt portion is arranged on the rear surface of the tile base, the tilt portion can be easily aligned with the vertical line. The rear foot portion having a predetermined thickness allows a tile fillet otherwise required in the known roof tile setting method to be eliminated. Construction efficiency is thus increased if the tiles of the present invention are used. The projection, front-and-back symmetrical with the clamp portion, is arranged on the upper side underlap so that the tile can stand alone in an upright position with both the projection and the clamp portion serving as feet. Conventionally required supporting stands are eliminated, and clay tiles can be easily placed in a furnace and then taken out easily from the furnace subsequent to the baking process. Manufacturing efficiency is thus improved. With the notch arranged in the center of the projection, the tiles can be arranged in a hound's-tooth check pattern. Tile setting variations can thus be enjoyed.

The tack of the present invention tacks the tile onto the backing horizontal bar, thereby supporting the lower side overlap portion from the front surface thereof. During a tacking process, the upper side underlap portion of the next downward tile in the self-interlocking engagement with the lower side overlap portion of the current tile is also tacked. The tiles are thus secured to the backing material without using any nails. The tack manufactured by bending a single metal wire is easy to manufacture. With the tack, the tiles can be easily set and removed by simply pivoting the hook portion about the axis of the support portion. The tile can thus be easily replaced.

REFERENCE NUMERALS

Figure 1A:
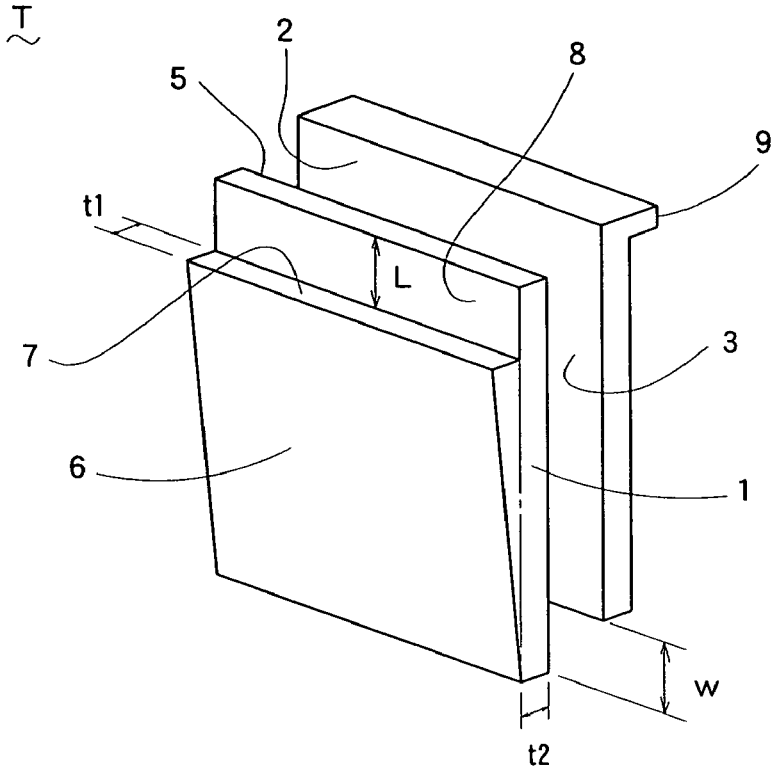
FIG. 1 is a perspective view generally illustrating a tile of first embodiment of the present invention.

1 Tile base
2 Upper side underlap portion
3 Right-hand side underlap portion
4 Lower side overlap portion
5 Left-hand side overlap portion
6 Tilt portion
7 Step portion
8 Front surface underlap portion of tile base
9 Clamp portion
10 Recess
22 Projection
27 Plug portion
28 Notch
30 Support portion
31 Connection portion
32 Hook portion
33 Anchor portion
52 Rear foot portion

DETAILED DESCRIPTION OF THE INVENTION

Figure 1B:
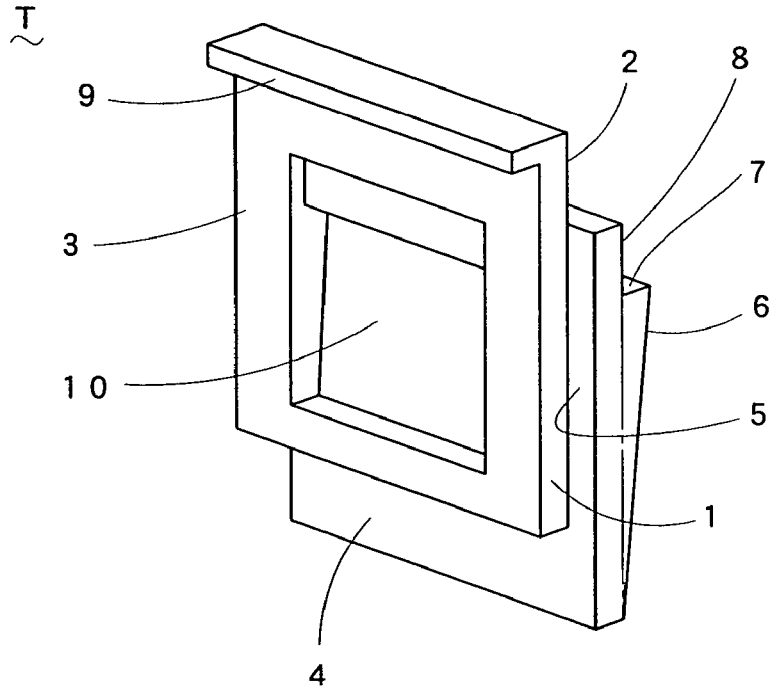

The preferred embodiments of the present invention are described below with reference to the drawings. FIG. 1 is a perspective view of an entire tile T of first embodiment of the present invention. FIG. 1(*a*) is a perspective view of the front side of the tile, and FIG. 1(*b*) is a perspective view of the rear side of the tile. The tile T includes underlap portions 2 and 3 respectively on the upper area and the right-area of the front surface of a tile base 1, and overlap portions 4 and 5 respectively on the lower area and the left area of the rear surface of the tile base. As in the prior art, the underlap portions 2 and 3 and the overlap portions 4 and 5 have identical shapes, respectively, and may be arranged in a plane vertically and horizontally in a self-interlocking manner.

The basic structure of the tile as the feature of the present invention is described below. The tile base 1 includes a tilt portion 6 inclined downward on the front surface thereof. In this embodiment, the tilt portion 6 extends from a step portion 7 at a position lower than the upper side of the tile base 1 by some length. More specifically, the length L from the upper side of the tile base 1 to the step portion 7 equals a projection W of the lower side overlap portion 4, and a thickness t1 of the step portion 7 equals a thickness t2 of the lower side overlap portion 4. As described later, in this arrangement, an area of the tile base 1, except the tilt portion 6, namely, an area extending from the upper side of the tile base 1 to the step portion 7 may be used as an underlap portion 8.

A clamp portion 9 extends from top edge of the rear surface of the upper side overlap portion 2. The clamp portion 9 is engaged with a backing horizontal bar to fix position of the tile T during interior or exterior construction of building. A recess 10 is formed on the rear surface of the tile base 1, and reduces the weight of the tile T. The volume saved by the recess 10 may be used for the tilt portion 6 to rationalize tile manufacturing.

Figure 2:
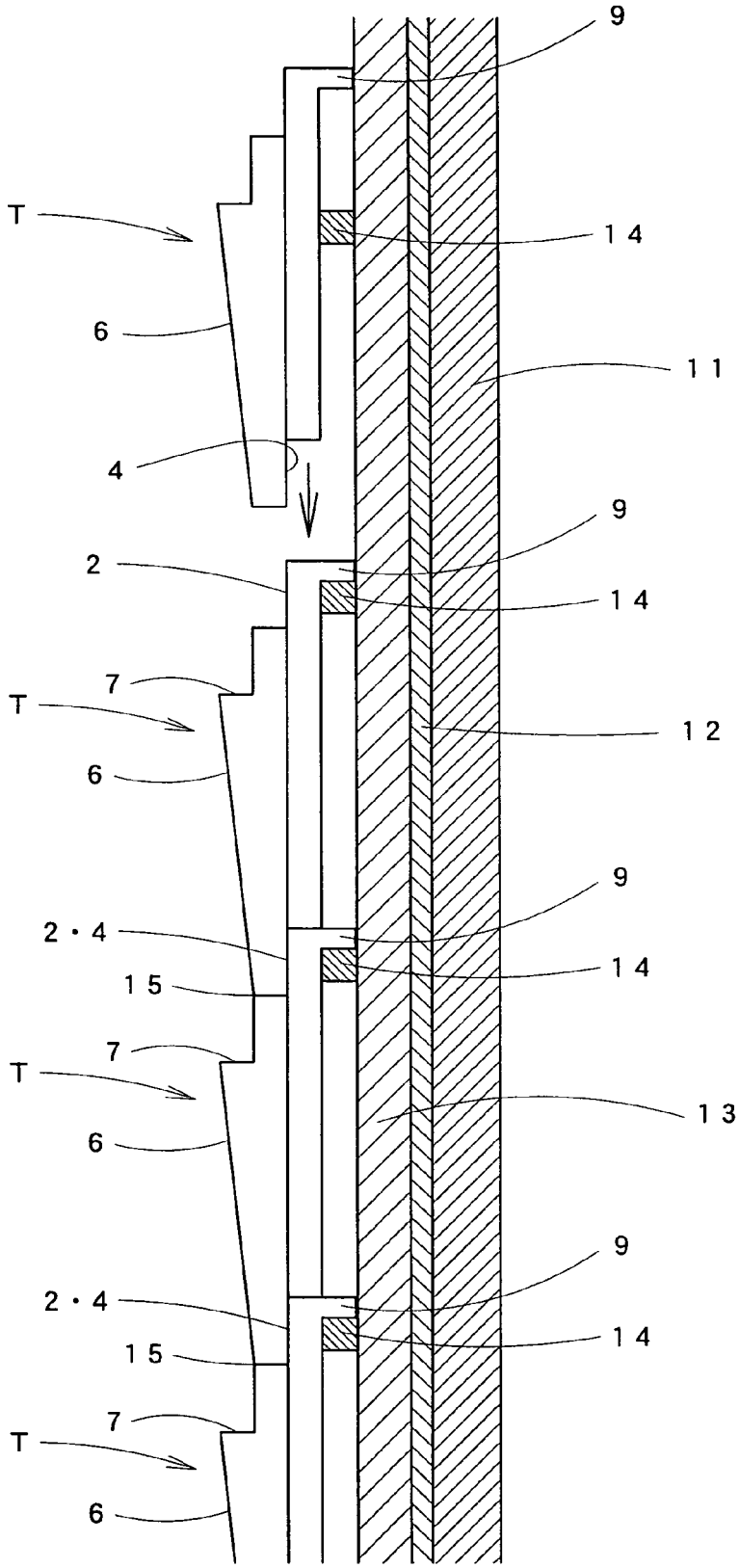
FIG. 2 is a side view of a wall bearing the tiles of the embodiment of the present invention.

FIG. 2 shows a wall having the above-described tiles T mounted thereon. Posts 11 as a backing material are erected at predetermined pitches, and a furring strip 13 is attached to a waterproof sheet 12 secured onto the posts 11 in the same way as in the conventional tile setting method. Horizontal bars 14 are arranged on the furring strips 13 vertically at regular intervals. The clamp portion 9 of the tile T is engaged with the horizontal bar 14. The tiles T are arranged horizontally and vertically on the backing material in a self-interlocking manner with the overlap portions 4 and 5 respectively engaged with the underlap portions 2 and 3. The tilt portion 6 of the tile T of the wall surface thus constructed urges rain water to run down, and makes it difficult for rain water to be leaked into through a joint 15. The presence of the step portion 7 and the tilt portion 6 provides an impression different from that of the conventional tile. An aesthetically excellent wall covering thus results.

Figure 3:
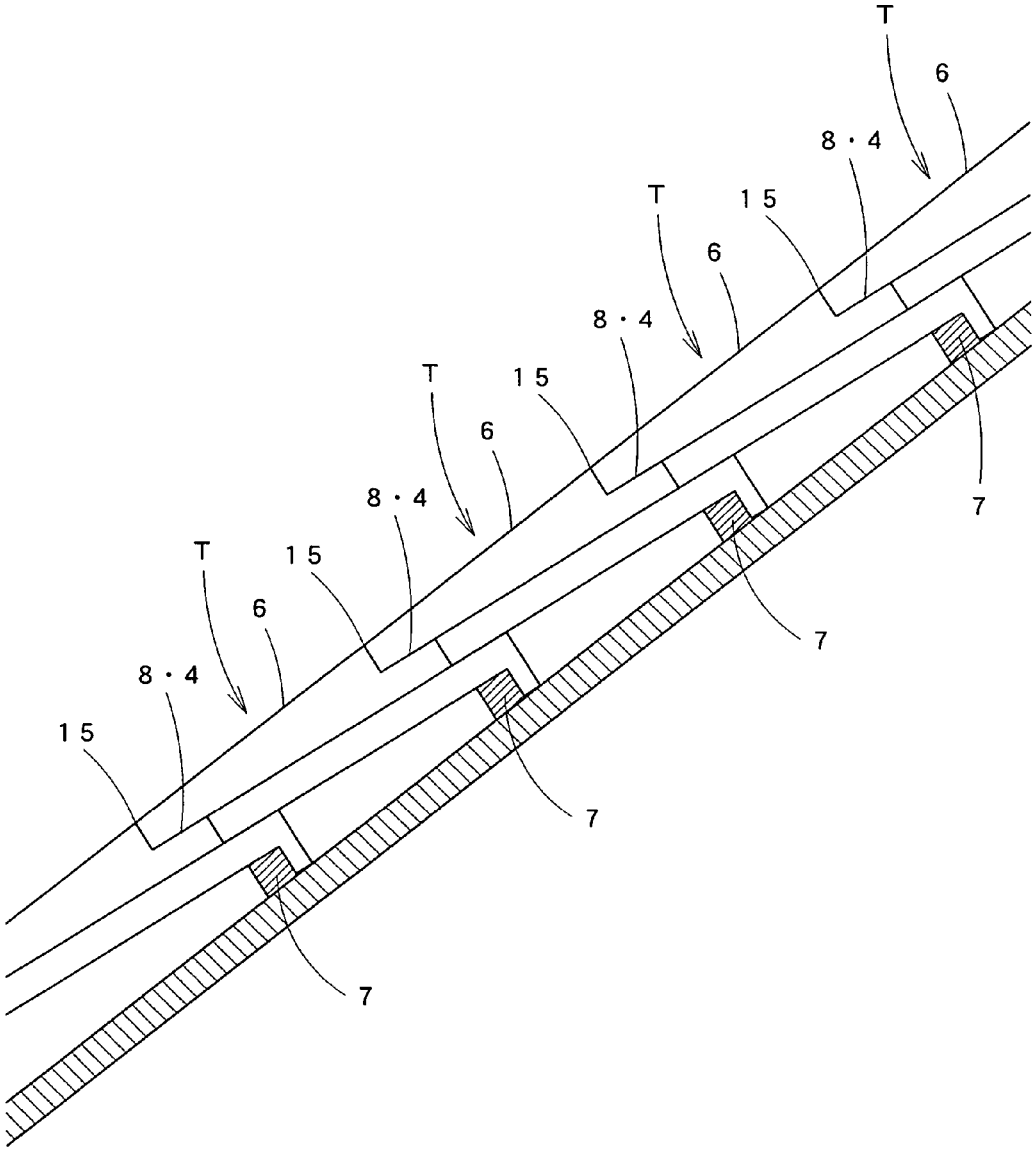
FIG. 3 is a side view illustrating a roof bearing the tiles.

FIG. 3 illustrates another tile setting method to build a roof. In this case, the front-surface underlap portion 8 formed on the surface of the tile base 1 is engaged with the lower side overlap portion 4 in a self-interlocking manner. In this arrangement, tiles T above and below a tile T of interest are arranged at a tilt angle because of the thickness t1 of the front-surface underlap portion 8 formed on the surface of the tile base 1, and the tiles T can thus be used as roof tiles on a roof. The tilt portion 6 provides a slope along which the rain water runs, and prevents rain water from leaking through the joint 15. Since the thickness t1 of the step portion 7 equals the thickness t2 of the lower side overlap portion 4, the step portion 7 is hidden by the lower side overlap portion 4. The tilt surfaces 6 of the tiles T are flush with each other and thus forms a continuous slope free from step. As a result, an aesthetically pleasing roof results.

Figure 4:
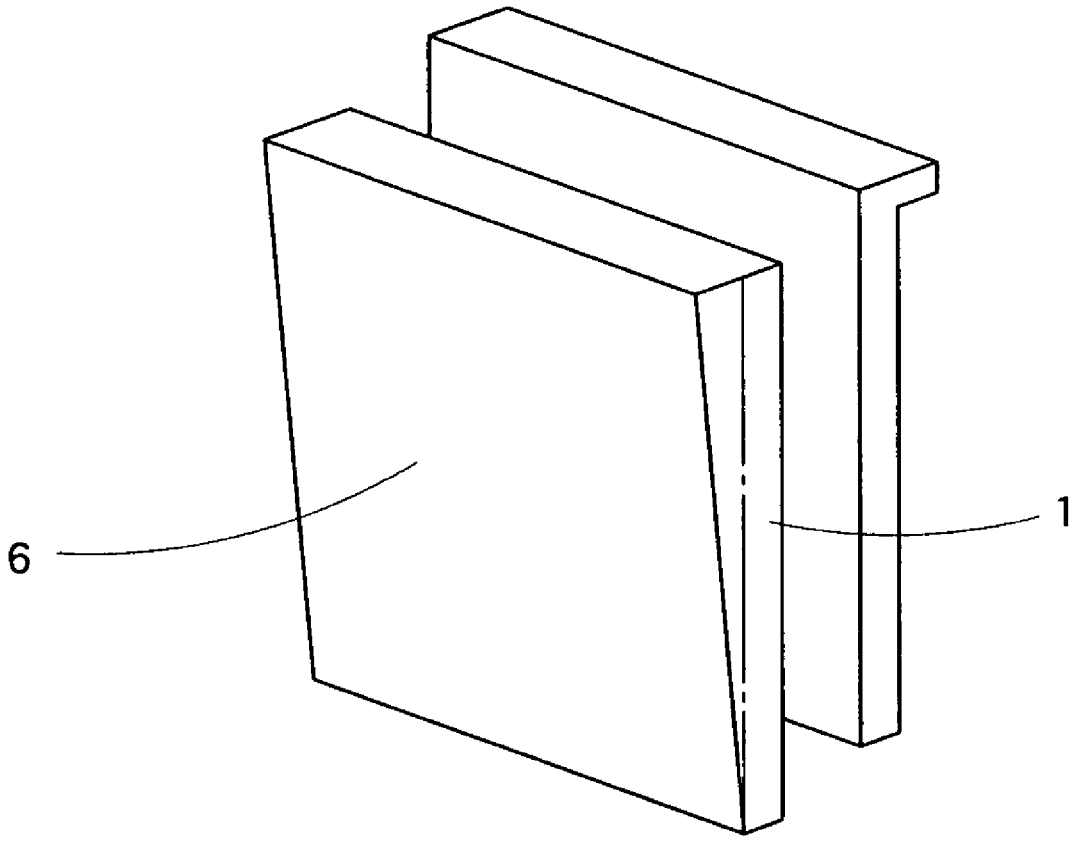
FIG. 4 is a perspective view of a tile in accordance with another embodiment of the present invention.

In the above embodiment, the tilt portion 6 is formed together with the step portion 7 and the front-surface underlap portion 8. Alternatively, the entire front surface of the tile base 1 may be formed as a tilt portion 6 as shown in FIG. 4. The tilt portion 6 is simply tapered thinner as it goes downward, and is not necessarily planar. Optionally, the tilt portion 6 may be embossed. It is not necessary that the four sides of the tilt portion 6 be formed into straight line if the registration accuracy between the underlap portions 2 and 3 and the overlap portions 4 and 5 is assured.

Figure 5:
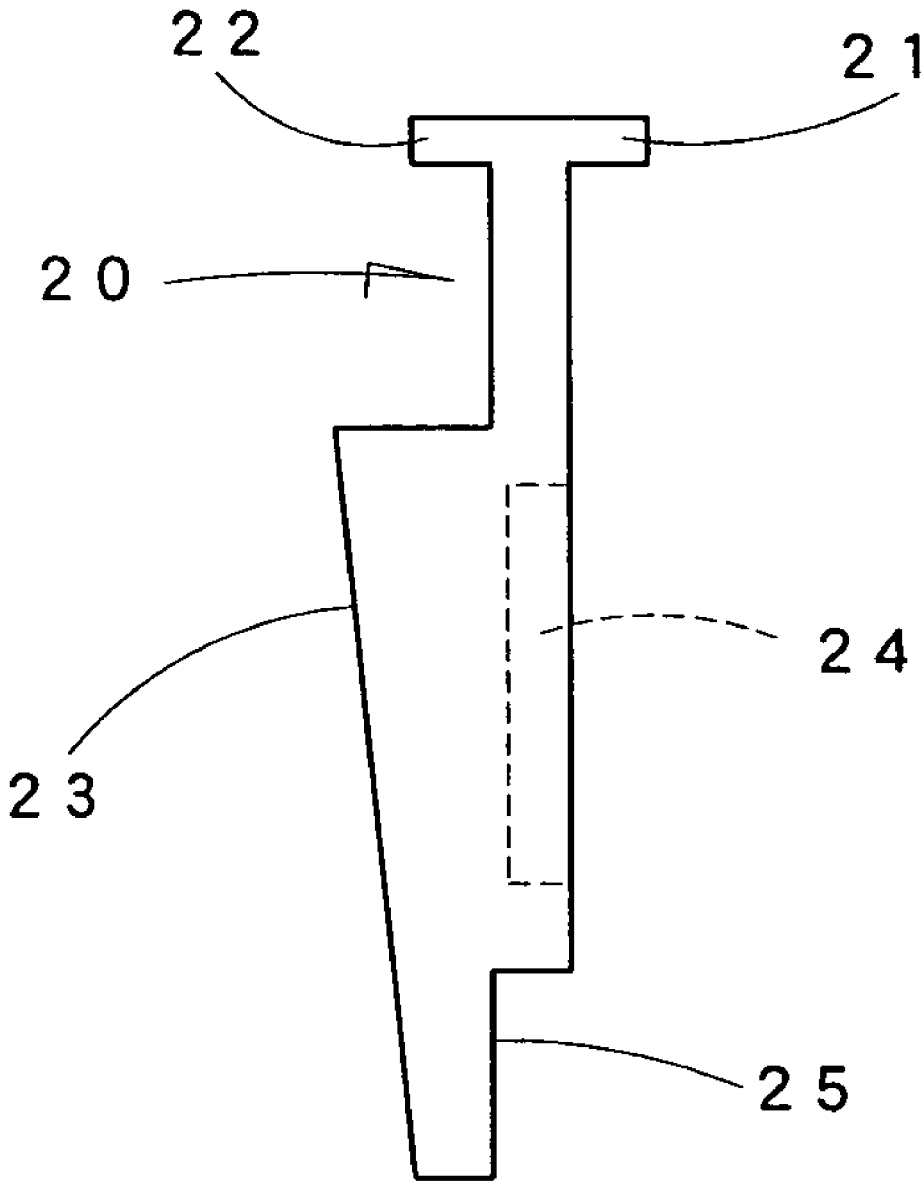
FIG. 5 is a side view of a tile in accordance with a second embodiment of the present invention.

FIG. 5 is a side view of a tile of a second embodiment of the present invention. In this embodiment, a clamp portion 21 and a projection 22 are formed on the upper side of an upper side underlap portion 20. The projection 22 is formed on the front surface of the upper edge of the upper side underlap portion 20 and extends to opposite side of the clamp portion 21. When the tile T is placed in a blast furnace with the top edge of the upper side underlap portion 20 down on the ground, the projection 22 and the clamp portion 21 serve as feet for keeping the tile T self-standing in a standalone position. The protrusion dimension of each of the projection 22 and the clamp portion 21 is designed so that the tile T is not easily tipped over. If the thickness of the tile T changes depending on the shape of a tilt portion 23 on the front surface and a recess 24 on the rear surface of the tile T, the center of gravity of the tile T in the standalone position thereof also changes. The protrusion dimensions of the clamp portion 21 and the projection 22 do not equal each other, and the protrusion dimension of the projection 22 is preferably as small as possible to minimize the possibility of touching with a lower side overlap portion 25 when the tiles T as a finished product after baking are interlocked with each other. The protrusion dimension of the projection 22 is preferably determined so that the tile T is balanced in the standalone position thereof and free from touching with the lower side overlap portion 25. Alternatively, the projection 22 may be intentionally broken to adjust the protrusion dimension so that no touching takes place. This breaking operation includes breaking away the entire projection 22. If the projection 22 is left partly or entirely, the remaining part of the projection 22 may be used as an inner water barrier of the wall.

Figure 6:
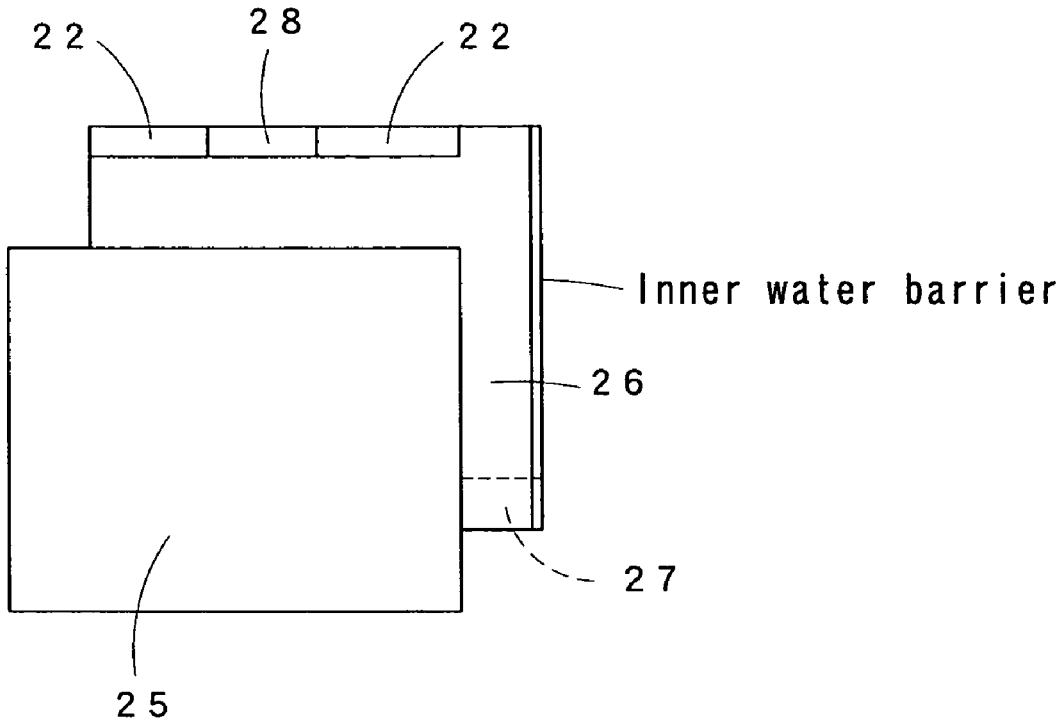
FIG. 6 is a front view of the tiles.
Figure 7:
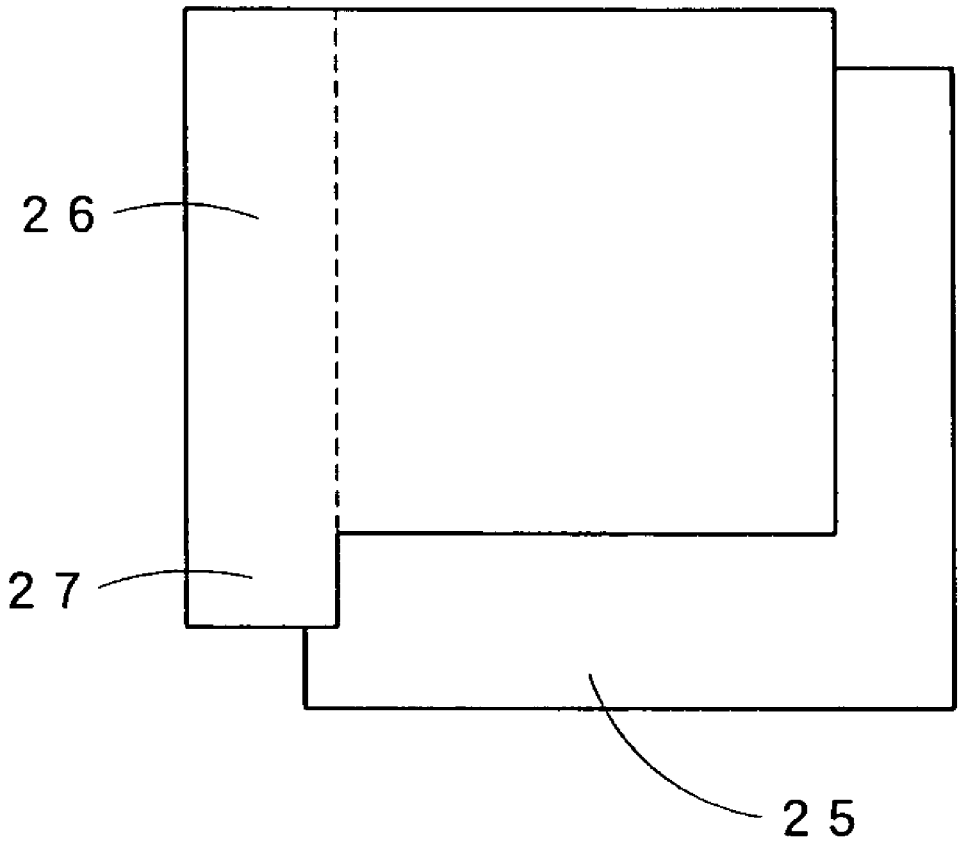
FIG. 7 is a rear view of the tiles.
Figure 8:
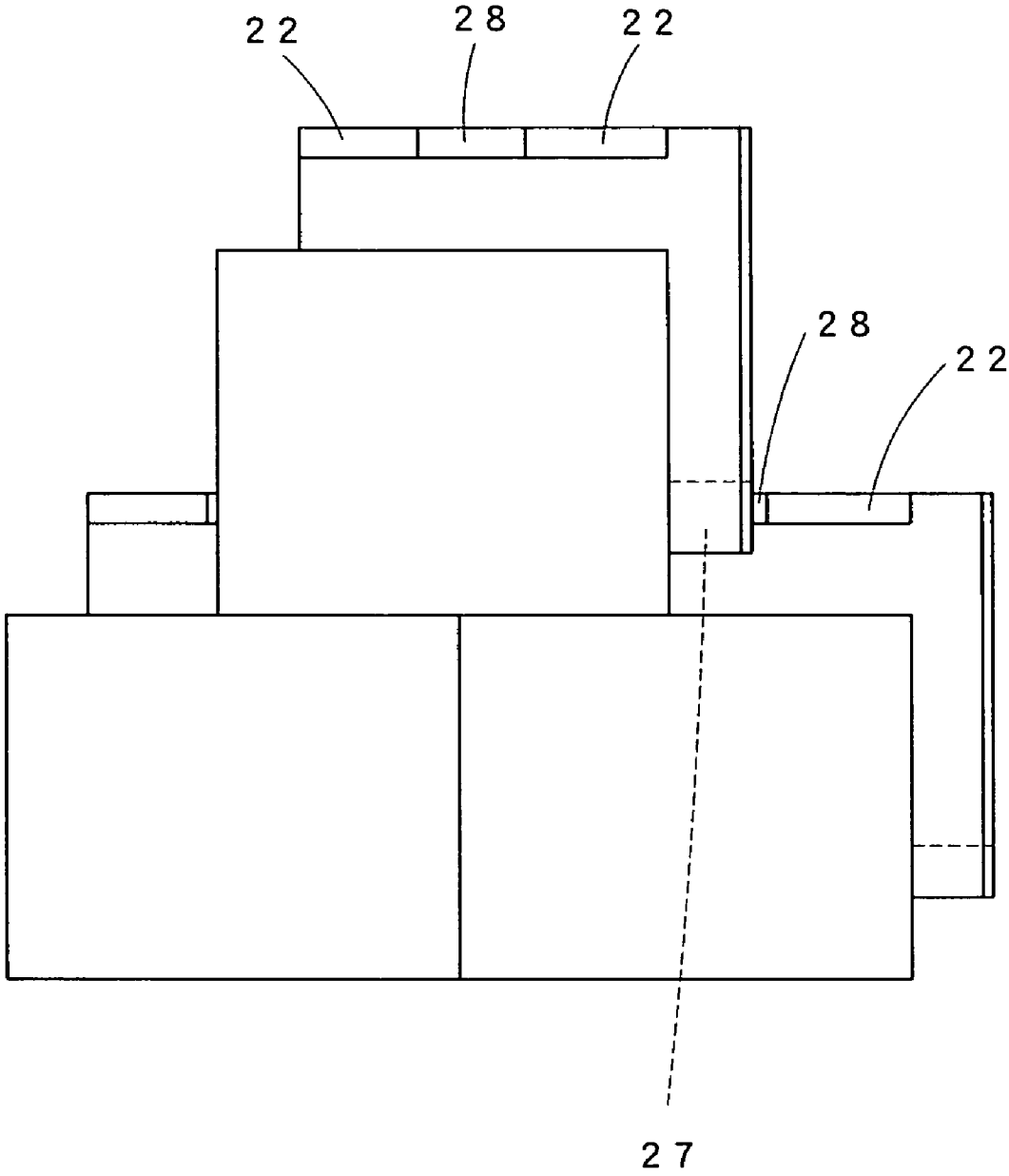
FIG. 8 is a front view of a wall surface constructed of the tiles.

FIG. 6 is a front view of the tile of FIG. 5 and step portion 7 is a rear view of the tile of FIG. 5. In the tile of the second embodiment, a lower side underlap portion 26 is extended to a lower side overlap portion 25 on the rear surface thereof. A plug portion 27 is formed at a corner of the rear surface (see FIG. 7) and a notch 28 is formed at the center of the projection 22 at the upper edge of the upper side underlap portion 20 on the front surface thereof (see FIG. 6). In this embodiment, the projection 22 is partly or entirely left subsequent to the bake operation. When the tiles are set in the self-interlocking manner, the plug portion 27 of the upper tile is engaged with the notch 28 of the previously set tile as shown in FIG. 8. The tiles can thus be arranged in a hound's-tooth check pattern.

Figure 9:
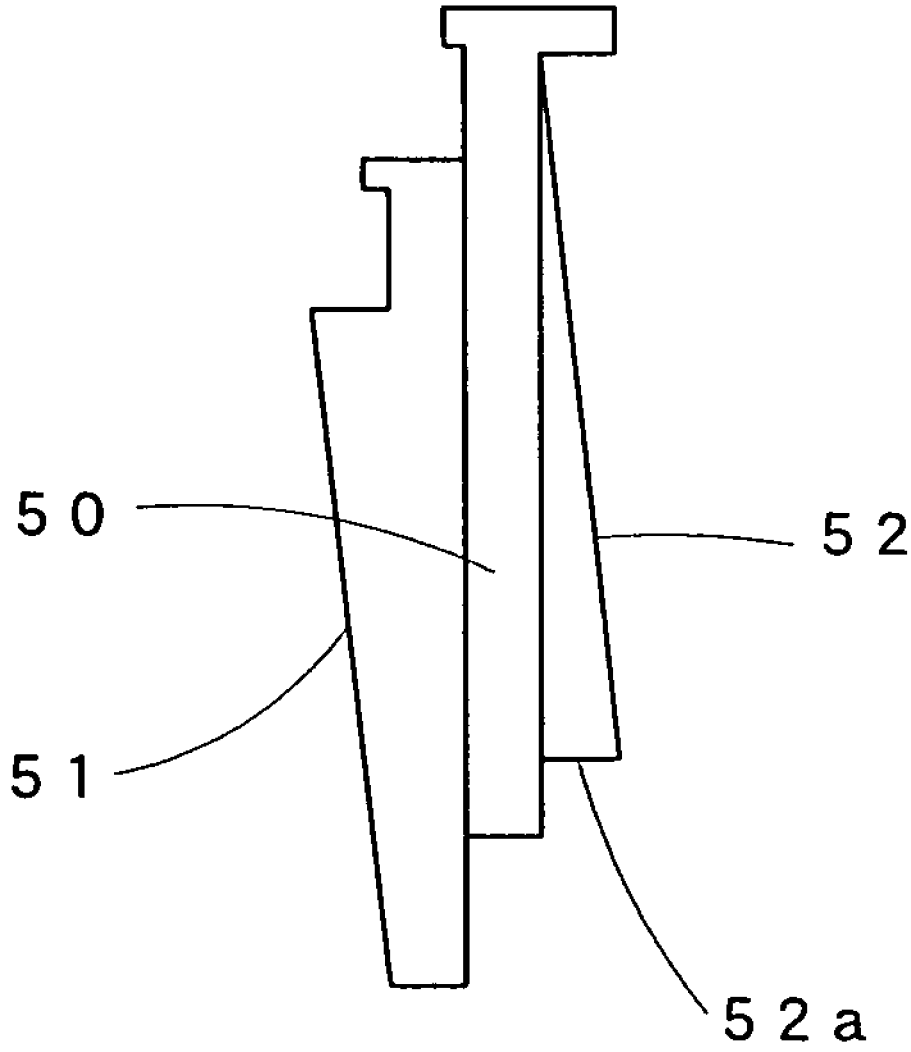
FIG. 9 is a side view of tiles in accordance with a third embodiment of the present invention.
Figure 10:
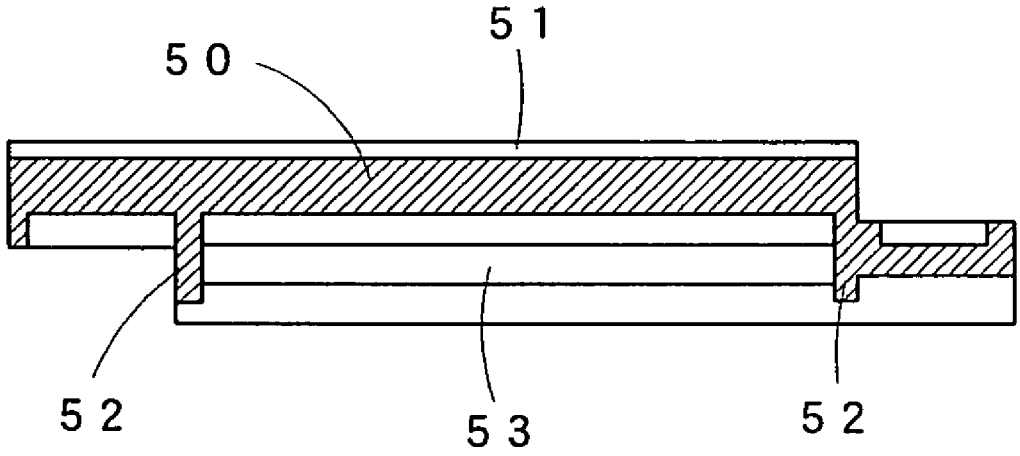
FIG. 10 is a cross-sectional view of the tile.

A third embodiment of the present invention is described below with reference to FIG. 9. The tile of this embodiment includes a tilt portion 51 tapered thinner downward along the front surface of a tile base 50. The tile base 50 also includes on the rear surface thereof a rear foot portion 52 having a slope surface running in parallel with the tilt portion 51. The rear foot portion 52 may be formed of the entire rear surface of the tile base 50. Alternatively, as shown in FIG. 10, a recess 53 is formed at the center of the rear surface of the tile base 50 in a way similar to the one discussed with reference to the first embodiment. Two foot portions 52 may be formed in parallel at the left and right-hand sides of the recess 53. The rear foot portion 52 on the rear surface of the tile base 50 runs in parallel with the tilt portion 51.

When the tiles thus constructed are set for wall application, the slope of the rear foot portion 52 is placed into contact with a vertically running backing material of the wall. The entire tile is thus mounted at a tilt angle of the rear foot portion 52 (in a tilt forward position). As a result, the tilt portion 51. on the front surface of the tile at the same tilt angle of the rear foot portion 52 is in a vertically upright position. The tilt portion 51 is thus easily vertically aligned.

In accordance with this embodiment, a protrusion dimension of a bottom projection 52*a* which is the thickest portion of the rear foot portion 52 viewed from side is set to a predetermined value so that a tile fillet on a lath arranged on the edge of eaves is eliminated at the tile setting. During normal tile setting, a lath is typically arranged as a horizontal bar connecting roof rafters at the edge of eaves, and a tile fillet is arranged on the lath. The head of the lower-most tile is placed onto the tile fillet. With the tiles of the present invention, the use of the tile fillet is eliminated by setting the protrusion dimension of the rear foot portion 52 to be equal to the height of the tile fillet.

When the tiles of the present invention are used as roof tiles, the rear foot portion 52 is not necessarily set to be in parallel with the tilt portion 51. By projecting the lower edge of the tile base 50 by a predetermined dimension (the same dimension of the height of the tile fillet), a rear foot portion 52 is arranged. The tile fillet is thus eliminated.

The rear foot portion 52 of the third embodiment and the projection of the second embodiment may be used on the tile of the first embodiment at the same time or may be used on the tile of the first embodiment individually.

Figure 11:
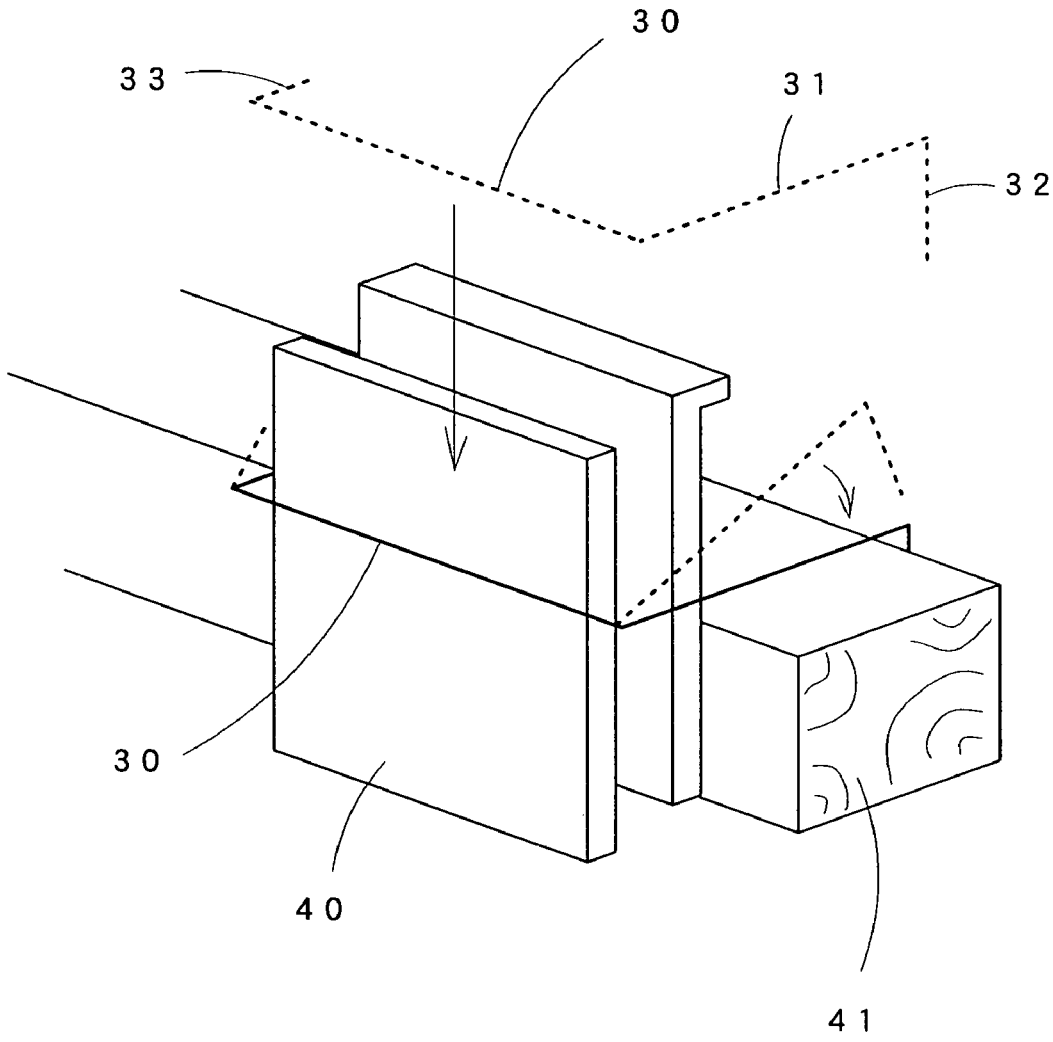
FIG. 11 is a perspective view of a tack of one embodiment of the present invention.

FIG. 11 illustrates a tack of the tile of the present embodiment. The tack includes a support portion 30 having a length matching the width of the lower side overlap portion 40 of the tile, a connection portion 31 that is bent by around 90 degrees from one end of the support portion 30 and extends toward the rear surface of the tile, and a hook portion 32 that extends from the connection portion 31 and is bent downward from the back end of the connection portion 31. The hook portion 32 is hooked on the upper side of the backing horizontal bar 41. The length of the connection portion 31 is set to be equal to the length from the front surface of the tile to the back side of backing horizontal bar. An anchor portion 33 is bent from the other end of the support portion 30 and extends from the bent position into the same direction as the connection portion 31 (in a horizontal direction). The anchor portion 33 is engaged with the left-hand side of the tile. The tack having these portions is manufactured by bending a single metal wire.

The tack is loaded to the backing horizontal bar 41 by pivoting the hook portion 32 about the support portion 30 with the support portion 30 engaged with the lower side overlap portion 40 of the tile.

The setting example using the tack causes a gap between horizontally adjacent tiles because of the connection portion 31 and the anchor portion 33. Rain water leaking through the gap is unavoidable. By arranging a water barrier on the left-hand side underlap portion of the tile, a water passage is provided on the joint and rain water is thus prevented from reaching the rear side of the tile.

The invention claimed is:

1. A tile comprising:

a tile base, an underlap portion formed on each of an upper side and one of a right-hand side and a left-hand side of said tile base, an overlap portion having identical shape with said underlap portion and formed on each of a lower side and the other of the right-hand side and the left-hand side of said tile base, a step portion having a step size equal to a thickness of said lower side of said overlap portion and formed at a position lower than said upper side of said tile base by a distance equal to a dimension of said lower side of said overlap portion, wherein said underlap portion includes an area defined by said upper side of said tile base and said step portion, and a clamp portion projected from a rear upper side of said upper side of said underlap portion, wherein said clamp portion is engaged with a backing horizontal bar, wherein said tile is arrangeable vertically and horizontally in a self-interlocking manner with other identical tiles and is characterized by having a tilt portion tapered thinner toward the lower end of a front surface of said tile base.

2. The tile according to claim 1, wherein said tile comprises a rear foot portion formed on a rear surface of said tile base and having a slope surface running in parallel with said tilt portion.

3. The tile according to claim 2, wherein the maximum thickness of said rear foot portion is set to be equal in dimension to a height of a roof tile fillet.

4. The tile according to claim 1, comprising a rear foot portion projecting from a rear lower side of said tile base by the same dimension as the height of a roof tile fillet used during roof tile setting.

5. The tile according to claim 1, comprising a breakable projection extended from a location on a front surface on a top portion of said upper side of said underlap portion in a front-and-back symmetrical with said clamp portion, wherein when said tile is placed on the ground with the upper side down, said projection and said clamp portion serve as feet for said tile standing alone in upright position.

6. The tile according to claim 5, wherein a rear side of said underlap portion is extended to a lower side of said overlap position to form a plug portion and a notch portion is formed in the center of said projection so that said plug portion is received by said notch portion.

7. The tile according to claim 5, wherein said projection is breakable with a portion thereof left.

8. The tile according to claim 1, comprising a recess portion on a rear surface of said tile base.

9. A tack for use with the tile which comprises a tile base, an underlap portion formed on each of an upper side and one of a right-hand side and a left-hand side of said tile base, an overlap portion having identical shape with said underlap portion and formed on each of a lower side and the other of the right-hand side and the left-hand side of said tile base, and a tilt portion tapered thinner toward the lower end of a front surface of said tile base, Wherein said tack comprises a support portion supporting said front surface of said lower side of said overlap portion and a hook portion being bent at by around 90 degrees and extending horizontally from one end of said support portion to a rear surface of said tile and then being bent downward to engage with an upper edge of a backing horizontal bar.

* * * * *